United States Patent [19]

Loew

[11] Patent Number: 4,903,866

[45] Date of Patent: Feb. 27, 1990

[54] GRAVITY DISPENSING BIN SYSTEM

[75] Inventor: Jonathon Loew, East Meadow, N.Y.

[73] Assignee: Design Display Group Inc., Fairlawn, N.J.

[21] Appl. No.: 232,806

[22] Filed: Aug. 16, 1988

[51] Int. Cl.[4] ..... B67D 5/64

[52] U.S. Cl. ..... 222/129; 222/143; 222/165; 222/180; 222/457; 312/248; 312/251; 312/270; 312/327

[58] Field of Search ..... 222/457, 164, 165, 166, 222/180, 181, 185, 143, 129, 564; 312/248, 251, 254, 270, 326–329; 211/81, 84, 99, 126; 248/133, 134, 225.1, 225.2, 311.2

[56] References Cited

U.S. PATENT DOCUMENTS

| | | | |
|---|---|---|---|
| 924,197 | 6/1909 | Shook | 312/327 |
| 2,081,725 | 5/1937 | Ainsa | 222/457 X |
| 2,754,998 | 7/1956 | Doepke et al. | 222/457 X |
| 2,755,001 | 7/1956 | Doepke et al. | 222/457 X |
| 3,352,614 | 11/1967 | Andersen | 312/327 X |

*Primary Examiner*—H. Grant Skaggs
*Assistant Examiner*—David H. Bollinger
*Attorney, Agent, or Firm*—Steinberg & Raskin

[57] ABSTRACT

A gravity dispensing bin system includes one or more gravity dispensing bins in which bulk product supplied through an open top of the bin moves under gravity to a lower dispensing opening as product is dispensed, and a frame on which the dispensing bins are mounted. A plurality of bins may be mounted in vertically and/or horizontally aligned arrangement on the frame and the frame with the bin or bins mounted thereon may itself be mounted on any suitable structure, such as a wall, pegboard or column, or alternatively, may be free-standing. Each bin has an open top which is normally covered by the bottom of the next upper adjacent bin or an overlying frame portion in the case of the uppermost bin. The bins are hingedly mounted on the frame so that each can be tilted to provide access to the open top for filling with product.

10 Claims, 3 Drawing Sheets

FIG. 2
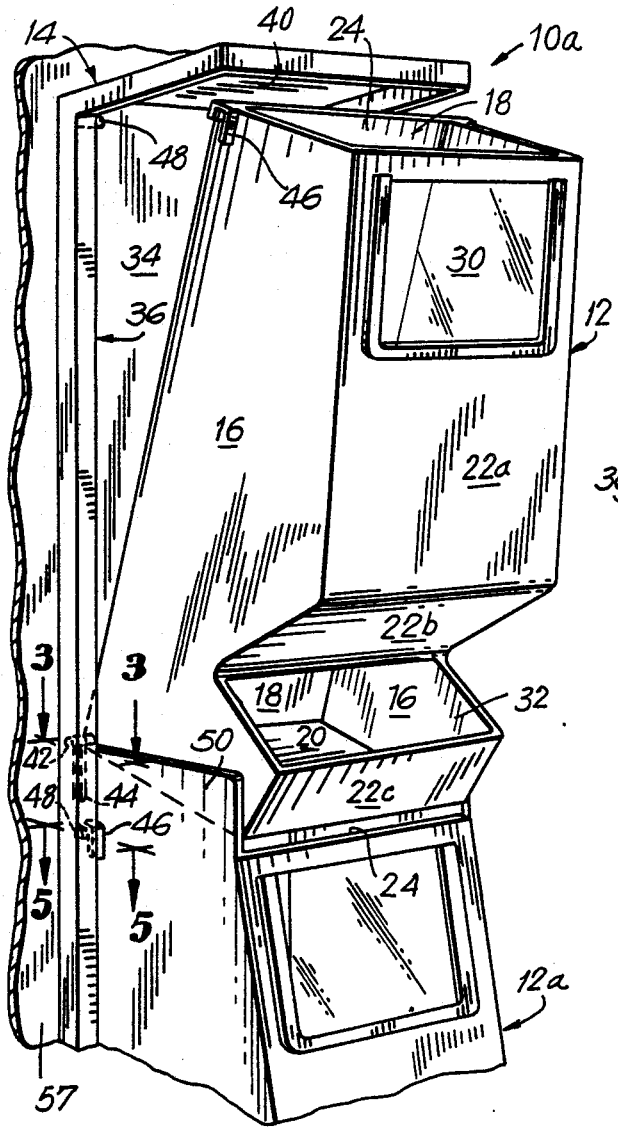
FIG. 3
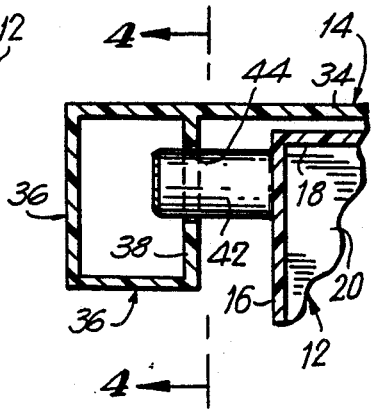
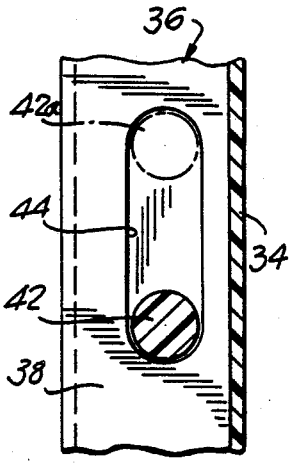
FIG. 4

FIG. 5
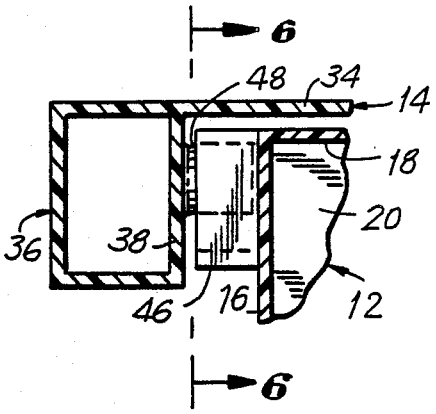
FIG. 6
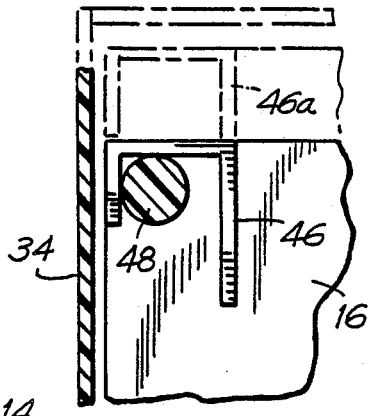
FIG. 7
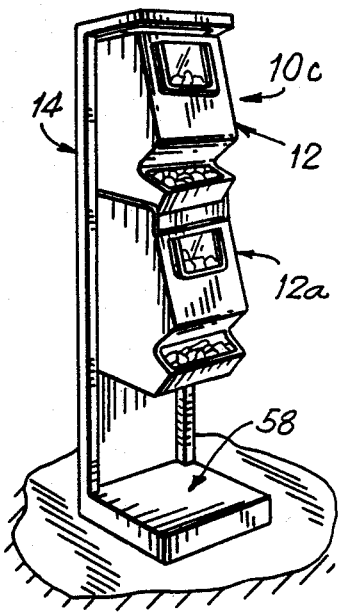
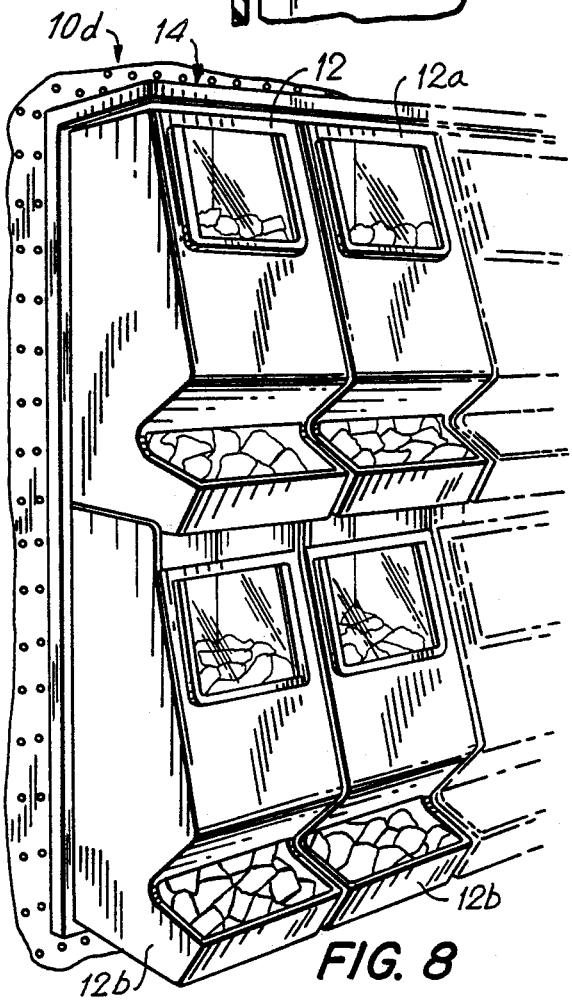
FIG. 8

GRAVITY DISPENSING BIN SYSTEM

BACKGROUND OF THE INVENTION

This invention relates generally to dispensing apparatus and, more particularly, to gravity dispensing bin apparatus in which bulk material products supplied through the upper end of the bin moves under gravity to a lower dispensing opening as product continues to be dispensed.

Gravity dispensing bins for dispensing bulk products are well known. For example, bins of this type are used for dispensing bulk products as diverse as hardware, such as nuts and bolts, food, such as nut and candy mixes, as well as many other types of products. Generally, the bin comprises an enclosure having an opening at its upper end through which the product is supplied into the bin to a level below the filling opening, and an opening at its lower end through which product situated in the bottom of the bin may be dispensed. As product is removed from the bottom of the bin through the lower dispensing opening, product remaining within the bin moves downwardly under gravity to the bottom of the bin to provide new product ready for dispensing. The bins are often formed with downwardly converging inner walls which form a chute to meter the downward flow of material within the bin.

It has been conventional to construct gravity dispensing bins as free-standing units for placement on horizontal shelves or counters, such as in a supermarket, hardware store or the like. Several bins may thus be situated next to each other on a single shelf. Where space is available on shelves which are situated one above the other, the bins may also be arranged in vertical alignment on the shelves.

It is of course desirable to be able to situate a plurality of bins in proximity to each other since different types or sizes of the same product should be made available in the same general area. However, counter or shelf space is not always available for free standing bins of the type described above to permit the most efficient arrangement of such bins.

A unitary gravity dispensing bin system is available wherein a pair of bins are integrally formed one above the other. The unitary system is also adapted to be located on a shelf or counter thereby limiting the flexibility of the system.

Another problem common to conventional gravity bin arrangements arises when the bins are located vertically above one another, either on respective shelves or in the form of an integral unitary structure. In particular, in such arrangements, it is not often possible to easily fill at least a lower one of the bins through a filling opening provided in the top side of the bin since in the case of free-standing bin arrangements the next upper adjacent shelf often is situated so close to the top of the bin as to prevent filling the bin through an opening in its top side. Where the filling opening is so provided, the bin must be removed from the shelf to be filled. On the other hand, in the case where a pair of bins are formed as a unitary construction, the bottom of the upper bin in effect forms the top of and closes the top side of the lower bin.

For these reasons, the filling opening of conventional gravity dispensing bins is often formed in the upper region of the front wall of the bin. Indeed, it is not uncommon for the filling opening to be defined by the absence of the portion of the front wall of the bin extending from the top of the bin to substantially the mid-height of the bin. However, this is disadvantageous since the bin of course can be filled only to the lower edge of the filling opening so that when the filling opening is provided in the front side of the bin, the bin can only be filled to a level of about one-half its height. This in turn results in the supply of product contained within the bin becoming exhausted on a relatively frequent basis.

SUMMARY OF THE INVENTION

It is an object of the present invention to provide new and improved gravity dispensing bin systems.

Another object of the present invention is to provide new and improved gravity dispensing bin systems wherein a plurality of bins can be arranged with respect to each other in a flexible and versatile manner.

A further object of the present invention is to provide new and improved gravity dispensing bin systems which do not require the availability of shelf or counter space.

Yet another object of the present invention is to provide new and improved gravity dispensing bin systems wherein bins having filling openings in their top side can be arranged in compact vertical arrangements while still permitting all of the bins to be filled through their open top filling openings in an easy manner.

Briefly, if accordance with the present invention, these and other objects are attained by providing a gravity dispensing bin system including at least one gravity dispensing bin, a frame, and means provided on the bin or bins and/or frame for mounting the bin or bins on the frame. The frame with the bin or bins mounted thereon is adapted to be itself mounted on any suitable structure such a wall, pegboard or column, or alternatively, may be free-standing.

The bins are preferably provided with open tops which function as filling openings thereby allowing each bin to be filled to its maximum capacity.

The means for mounting the bins on the frame preferably comprise means for pivotably or hingedly mounting each bin on the frame so that the bin can be tilted around an axis substantially passing through its bottom rear corner to provide access to the open top side of the bin for filling purposes.

In an arrangement wherein the bins are mounted on the frame in a vertically aligned arrangement, the open top of each bin is normally covered by the bottom of the next upper adjacent bin. The frame is provided with an overhanging or cantilevered frame portion at its top which acts as a cover for the filling opening of the uppermost bin of the arrangement.

DESCRIPTION OF THE DRAWINGS

A more complete appreciation of the present invention and many of the attendant advantages thereof will be readily understood by reference to the following detailed description when considered in connection with the accompanying drawings in which:

FIG. 2 is a perspective view of an embodiment of a gravity dispensing bin system according to the invention illustrating a bin in a tilted orientation for filling with product;

FIG. 3 is a section view taken along line 3—3 of FIG. 2;

FIG. 4 is a section view taken along line 4—4 of FIG. 3;

FIG. 5 is a section view taken along line 5—5 of FIG. 2;

FIG. 6 is a section view taken along line 6—6 of FIG. 5;

FIG. 7 is a perspective view of another embodiment of a gravity dispensing bin system in accordance with the invention wherein the frame is arranged as a free-standing unit; and FIG. 8 is a perspective view of another embodiment of a gravity dispensing bin system according to the invention wherein a plurality of bins are arranged on a single frame in horizontal and vertical alignment.

DETAILED DESCRIPTION OF THE PREFERRED EMBODIMENTS

Figure 1:
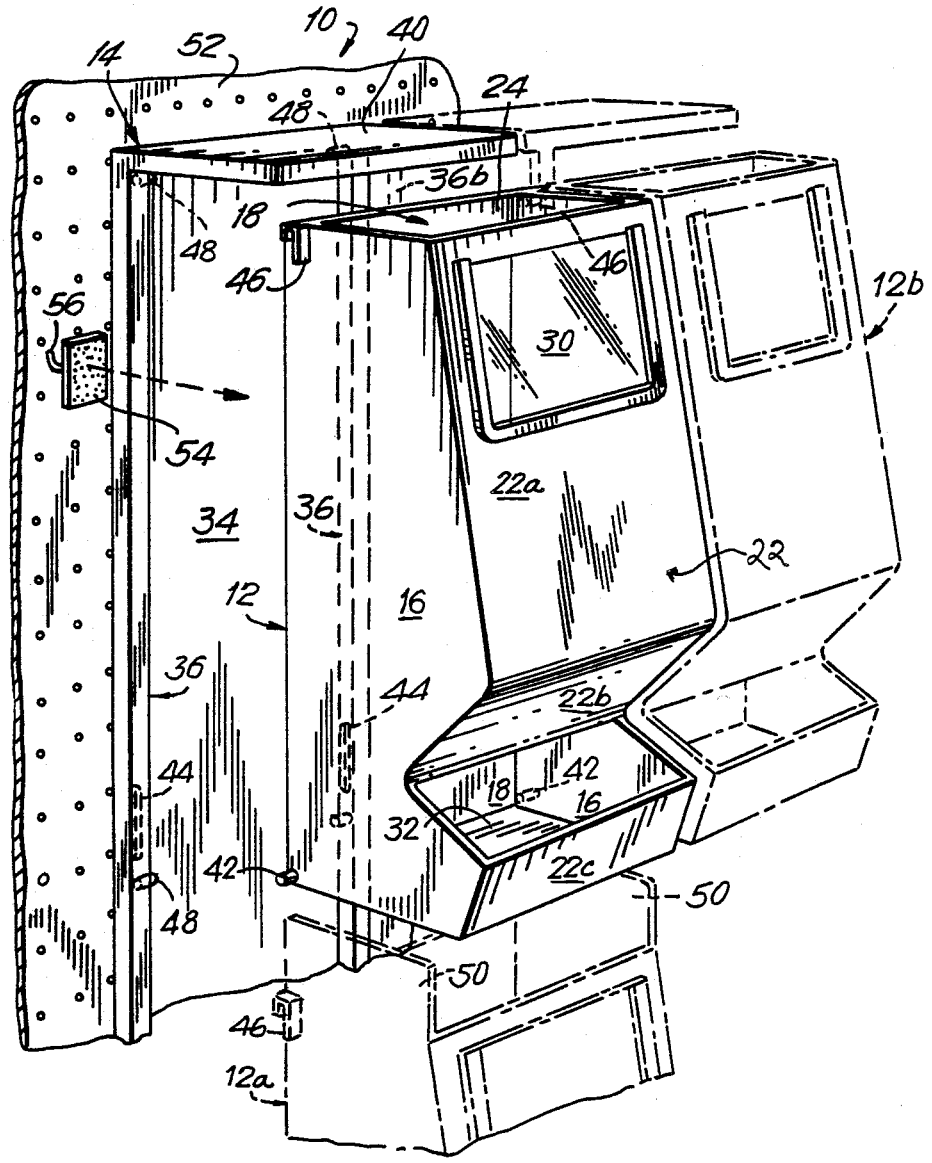
FIG. 1 is an exploded perspective view of an embodiment of a gravity bin dispensing system according to the invention adapted for mounting on a pegboard and illustrates in phantom embodiments wherein a plurality of bins are arranged in vertical and horizontal alignment.

Referring now to the drawings wherein like reference characters designate identical or corresponding parts throughout the several views, and more particularly to FIGS. 1-6, a gravity dispensing bin system in accordance with the invention is designated 10 in FIG. 1 and 10*a* in FIG. 2, and in its simplest form comprises a gravity dispensing bin 12 and a frame 14 on which bin 12 is mounted. Gravity dispensing bin 12 comprises an enclosure defined by a pair of opposed side walls 16, a rear wall 18, a bottom wall 20 and a front wall 22. The top side of bin 12 is open to define filling opening 24 through which product to be dispensed is supplied into the bin. Front wall 22 includes an upper portion 22*a* which diverges from rear wall 18 in a downward direction, a lower portion 22*b* which converges towards rear wall 18 in a downward direction, and a bottom lip portion 22*c*. A viewing window 30 is provided in the upper front wall portion 22*a*. A dispensing opening 32 is formed between the lower edge of front wall portion 22*b* and the upper edge of lip portion 22*c*. The gravity dispensing bin 12 operates in a conventional manner. Bulk product is charged into the bin through the filling opening 24. As product is dispensed from the bottom of bin 12 through the lower dispensing opening 32, product remaining in the bin moves downwardly towards the bottom of the bin under gravity to provide new product ready for dispensing. The rear wall 18 and the downwardly converging lower portion 22*b* of front wall 22 together form a chute which acts to meter the downward flow of product within the bin.

In accordance with the invention one or more gravity dispensing bins are adapted in a manner described below to be mounted on a separate frame component. In the embodiment illustrated in FIGS. 1 and 2, the frame component comprises a frame 14. Frame 14 essentially includes a substantially planar wall 34 and a pair of channels 36 extending in parallel relationship to each other along the side edges of wall 34. Each channel 36 includes an inwardly facing wall 38 (FIG. 5) which projects a small distance forwardly from, and at right angles to, frame wall 34. An overhanging wall portion 40 projects forwardly from the top of frame wall 34.

Bin 12 and frame 14 are provided with means for mounting the bin on the frame. In the embodiment illustrated in FIG. 1, the mounting means function to mount the bin 12 on frame 14 such that the rear wall 18 of bin 12 is normally situated contiguous to the frame wall 34 with the overhanging wall portion 40 of the frame overlying the filling opening 24 of the bin. The mounting means are such that the bin may be selectively tilted or pivoted forwardly around an axis located substantially at the rear edge of the bin as seen in FIG. 2. The ability to tilt the bin in this manner provides access to the filling opening 24 which otherwise is covered by the overhanging wall portion 40 of frame 14 thereby allowing the bin to be filled through the top side filling opening 24.

The mounting means employed in the embodiments of FIGS. 1 and 2 are the same and will be described with reference to both FIG. 1 as well as FIGS. 2-6. A pair of coaxial pivot pins 42 (FIGS. 1, 3 and 4) project laterally outwardly from the side walls 16 of bin 12 substantially at the region of the bottom rear corners thereof. The pins 42 are received in respective vertically elongated slots 44 formed in the inwardly facing walls 38 of channels 36 of frame 14. A pair of hook or hanger elements 46 (FIGS. 1, 5 and 6) are provided on bin side walls 16 at the region of the top rear corners thereof. The hanger elements 46 are adapted to engage respective hanger pins 48 which project inwardly from the inwardly facing channel walls 38 of frame 14.

In mounting the bin 12 on frame 14, pivot pins 42 are initially inserted into respective slots 44. The inwardly facing channel walls 38 are sufficiently flexible to yield outwardly during insertion. The bin 12 is then pivoted towards frame wall 34 and at the same time is lifted so that the pivot pins 42 are moved into the upper end regions of slots 44 as shown in phantom at 42*a* in FIG. 4. When the bin is pivoted towards the frame wall 34 with the pivot pins in their lifted position, the hanger elements 46 assume corresponding lifted positions as shown in phantom at 46*a* in FIG. 6 so that the bin can be situated with the hanger elements 46 located directly over the hanger pins 48 of frame 14. The bin is then lowered until the hanger elements 46 engage the hanger pins 48 with pivot pins 42 moving downwardly in slots 44 to complete the mounting procedure.

It will be understood that when it is desired to fill the bin 12, the bin is lifted to disengage the hanger elements 46 from the hanger pins 48 whereupon the bin 12 is pivoted away from frame 14 (FIG. 2) with pivot pins 42 supported at the lower ends of slots 44 to provide access to the filling opening 24. After the filling procedure is completed the bin is lifted and simultaneously moved towards frame 14 until the hanger elements 46 are located over the hanger pins 48 whereupon the bin is lowered until the hanger elements 46 are supported on hanger pins 48. As pointed out above, when bin 12 is mounted on frame 14, the overhanging frame wall portion 40 covers the filling opening 24 to effectively close the same to prevent pilferage.

In the case where one or more bins 12*a* are mounted on frame 14 vertically below bin 12, such as shown in FIG. 2, the same mounting means are utilized. Thus, the lower bin 12*a* of FIG. 2 is provided with pivot pins and hanger elements while the inwardly facing channel walls 38 of frame 14 are provided with corresponding elongated slots and hanger pins. The bottom wall 20 of upper bin 12 covers the filling opening of lower bin 12*a* to effectively close the same to prevent pilferage of its contents. Referring to FIG. 2, the lower bin 12*a* should be mounted such that the upper edge 24 of its upper front wall portion 22*a* is spaced a short distance from the bottom wall 20 of the upper bin 12 to allow the upper bin to be tilted during the filling operation. Panels 50 may extend upwardly from the side walls 16 of the lower bins 12*a* to cover the lateral spaces between vertically adjacent bins. In this connection, the side walls 16 of a bin should converge slightly towards each other in a downward direction to allow the panels 50 to overlap their lower regions.

In the case where one or more bins 12*b* are mounted on frame 14 in horizontal alignment with bin 12, additional vertically extending channels 36*b* (FIG. 1) must be provided. Thus, in the case where an additional bin 12*b* is provided on the right-hand side of bin 12 as shown in phantom in FIG. 1, an additional channel 36*b* must be provided on frame 14. Corresponding slots 44 and hanger pins 48 are formed in the appropriate channel walls as will be understood.

In accordance with the invention, the frame with the bin or bins mounted thereon may be adapted to be itself mounted on any suitable structure, such as a wall, peg board or column, or alternatively may be free standing. As seen in FIG. 1, frame 14 is adapted to be mounted on a peg board 52 by means of hooks 56 attached to brackets 54 which are fixed to the rear of the frame. The frame may be directly attached to a wall 57 as seen in FIG. 2. Referring to FIG. 7, the frame can be provided with a base portion 58 so that the bin-frame system 10*c* is free-standing. Other configurations are of course possible. For example, the frame may be free standing and one or more bins may be mounted on both sides of the frame. The frame may be provided in the form of a free-standing column having four sides and one or more bins may be mounted on each of the sides. Multiple numbers of bins, arranged in vertical and horizontal alignment, may be provided on a single frame as seen in the assembly 10*d* illustrated in FIG. 8.

It is seen from the foregoing that the gravity bin dispenser system of the invention provides a flexibility in the arrangement of bins not possible in the prior art. It is possible to provide the bins in vertical aligned arrangements while providing complete access to the filling openings formed in their top sides thereby allowing the bin to be filled to the maximum extent possible.

Obviously, numerous modifications and variations of the present invention are possible in the light of the above teachings. Therefore, it is to be understood that within the scope of the claims appended hereto, the invention may be practiced otherwise than as specifically disclosed herein.

What is claimed is:

1. A gravity dispensing bin system comprising:

a frame;

a least two gravity dispensing bins, each including an enclosure having side walls, a bottom wall, an upper filling opening provided in an upwardly facing top of said bin and a lower dispensing opening; and means provided on at least one of said frame and bins for removeably mounting at least two of said bins on said frame in substantially vertically aligned relationship, and wherein said mounting means comprise means for pivotally mounting a lower one of said bins on said frame for movement with respect to an axis passing through a rearward lower region of said bin between a first operating position wherein said bottom wall of a next adjacent upper bin substantially overlies said filling opening of said lower bin, and a second pivoted filling position wherein access is provided to said filling opening of said lower bin.

2. The system of claim 1 wherein said frame includes a pair of inwardly facing walls and wherein said side walls of each of said at least two bins face respective ones of said inwardly facing frame walls.

3. The system of claim 2 wherein said mounting means comprise means for removeably connecting said bin side walls to respective ones of said inwardly facing frame walls.

4. The system of claim 3 wherein said mounting means comprise a first pair of pins provided on one of either said pair of bin side walls or said pair of frame walls and a pair of openings in which said pins are received provided on the other of either said pair of bin side walls or said pair of frame walls.

5. The system of claim 4 wherein said one of said first pair of pins and said pair of openings are provided in a lower rear region of said bin side walls.

6. The system of claim 5 wherein said pair of openings comprise a pair of vertically elongated slots.

7. The system of claim 5 wherein said mounting means further comprise a pair of hanger elements provided on an upper rear region of said pair of bin side walls and a second pair of pins provided on said pair of frame walls adapted to engage said hanger elements.

8. The system of claim 1 wherein said frame includes a portion projecting forwardly from a top region thereof substantially overlying said filling opening of at least one of said bins.

9. The system of claim 1 further including means for mounting said frame on a vertical wall member.

10. The system of claim 1 wherein said frame includes base means for freely standing said frame on a horizontal support surface.

* * * * *